US005718502A

United States Patent [19]

Tseng

[11] Patent Number: 5,718,502

[45] Date of Patent: Feb. 17, 1998

[54] DECORATIVE LAMPS FOR FESTIVE OCCASIONS

[76] Inventor: Jeou-nan Tseng, No. 539, Sec. 4, Chunghua Rd., Hsinchu, Taiwan

[21] Appl. No.: 758,926

[22] Filed: Dec. 3, 1996

[51] Int. Cl.[6] ..... H01R 33/00

[52] U.S. Cl. ..... 362/226; 362/238; 362/267; 362/806

[58] Field of Search ..... 439/614, 658; 362/226, 806, 238, 267

[56] References Cited

U.S. PATENT DOCUMENTS

| | | | |
|---|---|---|---|
| 5,150,964 | 9/1992 | Tsui | 362/251 |
| 5,331,529 | 7/1994 | Huang | 362/226 |
| 5,339,232 | 8/1994 | Lin | 362/391 |

*Primary Examiner*—Stephen F. Husar
*Attorney, Agent, or Firm*—William E. Pelton

[57] ABSTRACT

A decorative lamps for festive occasions, whose lamp base can enclose not only wires of a regular diameter, but also wires with a larger diameter, is disclosed. The decorative lamps for festive occasions includes a lamp head having a bulb and a pair of first wires and a second wire extending therefrom. A hollow lamp base receives the lamp head and secures the first and second wires of the lamp head. The lamp base has defined on a lower portion of an inner wall thereof a pair of first recesses at one side for receiving the first wires and a second recess opposed to the first recesses for receiving said second wire, such that the first and second wires are arranged in a tri-lobic disposition. The decorative lamps for festive occasions further includes a block mounted within the hollow lamp base for preventing water from entering the lamp base and so providing a short circuit.

2 Claims, 2 Drawing Sheets

DECORATIVE LAMPS FOR FESTIVE OCCASIONS

BACKGROUND OF THE INVENTION

1. Field of the Invention

The present invention relates to a decorative lamps for festive occasions, and more particularly to a decorative lamps for festive occasions whose lamp base can enclose not only the regular wires, but also the wires with a diameter greater than the regular wires.

2. Description of Related Art

Decorative lamps for festive occasions strings are generally used for decorating a Christmas tree at Christmas Day. A conventional single decorative lamps for festive occasions typically has a structure as shown in FIGS. 4, 5 and 6. The decorative lamps for festive occasions comprises a lamp head 40 and a hollow lamp base 48. The lamp head 40 has a bulb 42 at a top and a holder 402 for securing the bulb 42. A first terminal 44 and a second terminal 46 are respectively electrically connected to a pair of contacts (not numbered) extending from the bulb 42. A pair of first wires 442, 444 is connected to the first terminal 44 in common and a second wire 462 is connected to the second terminal 46 to supply power to the bulb 42. The hollow lamp base 48 is provided for receiving the holder 402 and securing the first and second wires 442, 444, 462 of the lamp head 40. In assembly, it can be seen from FIG. 5 that the first and second wires 442, 444, 462 are arranged in a disposition of line. This arrangement has a disadvantage that the lamp base 48 can not contain some wires with various specifications, for example, those heavy duty wires with a large diameter stemming from a consideration of safety. Therefore, a large lamp base 48 for containing the heavy duty wires needs to be produced additionally and the specification of the packages needs to be modified correspondingly. This causes the fabrication cost of the lamp to be increased. A second disadvantage is that a conventional decorative lamp for festive occasions has no element to waterproof it. Once water enters the hollow lamp base 48, the bulb 40 will be short.

The present invention provides an improved decorative lamps for festive occasions to mitigate and/or obviate the aforementioned problems.

SUMMARY OF THE INVENTION

One object of the present invention is to provide a decorative lamps for festive occasions whose lamp base can enclose not only the regular wires, but also the wires with a diameter greater than the regular wires.

Another object of the present invention is to provide a decorative lamps for festive occasions which has a block mounted therein for preventing water from entering the lamp base and resulting in a short circuit.

In accordance with one aspect of the present invention, a decorative lamps for festive occasions includes a lamp head having a bulb and a pair of first wires and a second wire extending therefrom. A hollow lamp base receives the lamp head and secures the first and second wires of the lamp head. A lower portion of an inner wall of the lamp base defines a pair of first recesses at one side for receiving the first wires and a second recess opposed to the first recesses for receiving said second wire, such that to arrange the first and second wires are arranged in a tri-lobic disposition. Each of said recesses is shaped to cooperate with the respective configuration of the wires.

In accordance with another aspect of the present invention, the decorative lamps for festive occasions further includes a block mounted within the hollow lamp base for preventing water from entering the lamp base. The block is configured in such a manner that said first and second wires can extend therepast.

Other objects, advantages and novel features of the invention will become more apparent from the following detailed description when taken in conjunction with the accompanying drawings.

DETAILED DESCRIPTION OF PREFERRED EMBODIMENT

Figure 1:
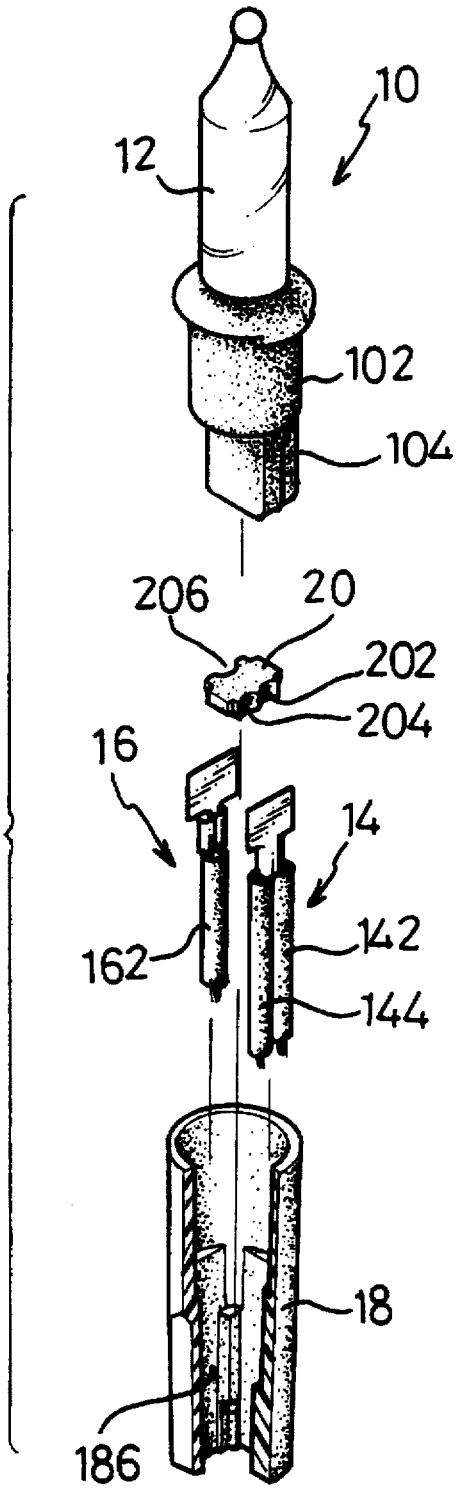
FIG. 1 is an exploded view showing the elements of a decorative lamps for festive occasions in accordance with the present invention.

Referring to FIG. 1, a decorative lamps for festive occasions in accordance with the present invention includes a lamp head 10. The lamp head 10 is configured in a conventional form and has a bulb 12 at a top, a holder 102 for securing the bulb 12 and a pair of contacts 104 extending downwardly from the bulb 12. A first terminal 14 and a second terminal 16 are respectively mounted to the contacts 104. A pair of first wires 142, 144 are both connected to the first terminal 14 and a second wire 162 is connected to the second terminal 16 to supply power to the bulb 12. The decorative lamps for festive occasions in accordance with the present invention further includes a hollow lamp base 18 for receiving the lamp head 10 and securing the first and second wires 142, 144, 162 of the lamp head 10. A top portion (not numbered) of the lamp base 18 is provided for receiving the holder 12, and a lower portion (not numbered) of the lamp base 18 is provided for containing the first and second wires 142, 144, 146.

Figure 3:
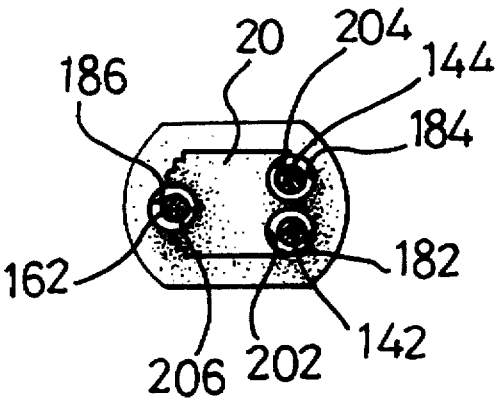
FIG. 3 is a bottom view of the decorative lamps for festive occasions, showing a first wire and a pair of second wires received within a lamp base.
Figure 4:
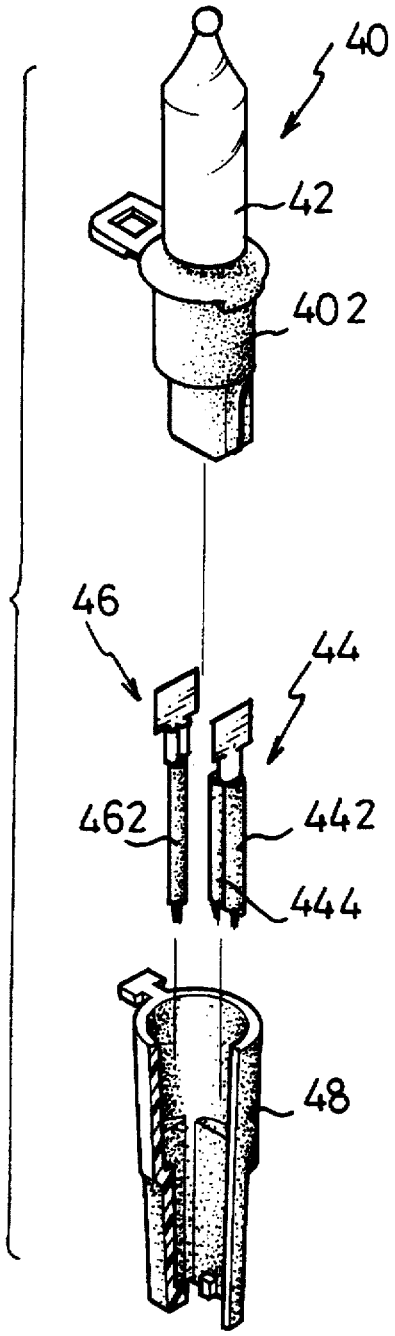
FIG. 4 is an exploded view showing the elements of a conventional decorative lamps for festive occasions.
Figure 5:
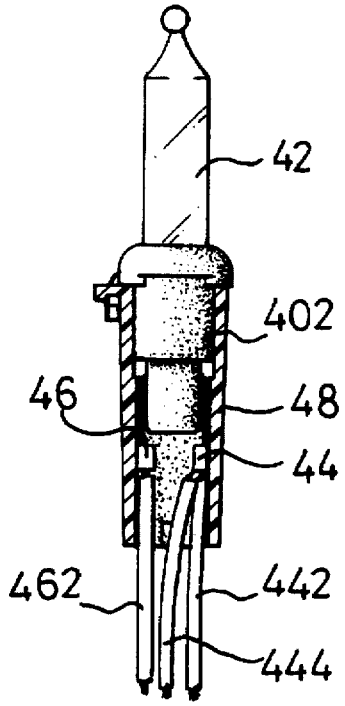
FIG. 5 is a cross-sectional view showing a combined structure of the conventional decorative lamps for festive occasions.
Figure 6:
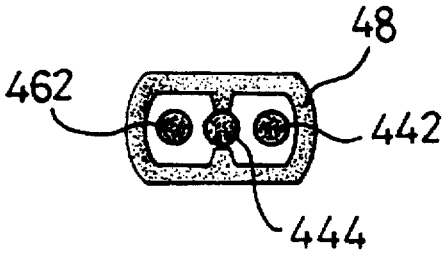
FIG. 6 is a bottom view of the conventional decorative lamps for festive occasions, showing a first wire and a pair of second wires received within a lamp base thereof.

With reference to FIG. 3, a pair of first recesses 182, 184 configured to respectively receive the first wires 142, 144 is juxtaposedly defined in a first inner sidewall of the lower portion of the lamp base 18. A second recess 186 configured to receive the second wire 162 is defined in a second inner side wall opposed to the first inner sidewall. Accordingly, the wires 142, 144, 162 are arranged in the respective recesses 182, 184, 186 in a tri-lobic disposition. Since the tri-lobic disposition prevents the wires 142, 144, 162 from occupying a large space within the lamp base 18 as the line disposition in a conventional lamp, it permits the lamp base 18 to enclose not only the regular wires, but also the wires with a diameter greater than the regular wires.

Still referring to FIG. 1, the decorative lamps for festive occasions in accordance with the present invention further includes a block 20 provided for preventing water from entering the lamp base 18 and so providing a short circuit.

Figure 2:
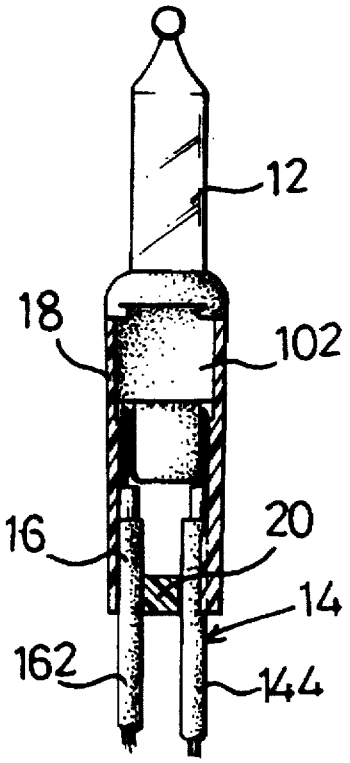
FIG. 2 is a cross-sectional view showing a combined structure of the decorative lamps for festive occasions in accordance with the present invention.

With a reference to FIG. 2, the block 20 is mounted between the first and second wires 142, 144, 162 within the lamp base 18 and is configured in such a manner that the first and second wires 142, 144, 162 are permitted to extend therepast. For this purpose, the block 20 defines a pair of abreast first notches 202, 204 with a configuration respectively corresponding to the first wires 142, 144, and a second notch 206 with a configuration corresponding to the second wire 162. This arrangement further helps the first and second wires 142, 144, 146 be secured in the corresponding recesses 182, 184, 186.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A decorative lamps for festive occasions comprising:

a lamp head having a bulb and a pair of first wires and a second wire extending therefrom; and a hollow lamp base for receiving the lamp head and securing said first and second wires of the lamp head, said lamp base defining on a lower portion of an inner wall thereof a pair of first recesses at one side for receiving said first wires and a second recess opposed to the first recesses for receiving said second wire, whereby said wires are arranged in a tri-lobic disposition, each of said recesses being shaped to cooperate with the configuration of said wires.

2. A decorative lamps for festive occasions as claimed in claim 1, wherein said lamp further includes a block mounted within the hollow lamp base for preventing water from entering the lamp base, said block being configured in such a manner that said first and second wires can extend therepast.

* * * * *